US005133339A

United States Patent [19]

Whalen et al.

[11] Patent Number: 5,133,339

[45] Date of Patent: Jul. 28, 1992

[54] EXERCISE METHOD AND APPARATUS UTILIZING DIFFERENTIAL AIR PRESSURE

[76] Inventors: Robert T. Whalen, 471 Distel Dr., Los Altos, Calif. 94022; Alan R. Hargens, 16345 Sanborn Rd., Saratoga, Calif. 95070

[21] Appl. No.: 685,607

[22] Filed: Apr. 15, 1991

[51] Int. Cl.[5] ..... A61H 1/02

[52] U.S. Cl. ..... 128/25 R; 128/202.12; 128/205.26; 600/19; 600/20; 482/51; 482/52; 482/54

[58] Field of Search ..... 128/24 R, 202.12, 205.26, 128/25 R; 272/69; 600/19, 20

[56] References Cited

U.S. PATENT DOCUMENTS

| | | | |
|---|---|---|---|
| 3,768,467 | 10/1973 | Jennings | 128/205.26 |
| 4,149,712 | 4/1979 | Murphy . | |
| 4,257,407 | 3/1981 | Macchi . | |
| 4,343,302 | 8/1982 | Dillon | 128/24 R |
| 4,411,422 | 10/1983 | Solloway . | |
| 4,509,513 | 4/1985 | Lasley | 128/202.12 |
| 4,576,376 | 3/1986 | Miller . | |
| 4,621,621 | 11/1986 | Marsalis . | |
| 4,712,788 | 12/1987 | Gandreau, Jr. . | |
| 4,776,581 | 10/1988 | Shepherdson . | |
| 4,959,047 | 9/1990 | Tripp, Jr. | 128/202.12 |
| 4,974,829 | 12/1990 | Gamow et al. | 128/205.26 |

OTHER PUBLICATIONS

Cooper and Ord, "Physical Effects of Seated and Supine Exercise With and Without Subatmospheric Pressure Applied to the Lower Body", *Aerospace Medicine;* May 1968, pp. 481–484.

Brown et al., "Circulatory Responses to Simulated Gravitational Shifts of Blood in Man Induced by Exposure of the Body Below the Iliac Crests to Sub-Atmospheric Pressure", *J. Physiol.* (1966), 183, pp. 607–627.

Eiken, "Response to Dynamic Leg Exercise in May as Influenced by Changes in Muscle Perfusion Pressure", *Acta Physiologica Scandivavica,* vol. 131, Suppl. 566 (1987).

*Primary Examiner*—Richard J. Apley
*Assistant Examiner*—Susan L. Weinhoffer
*Attorney, Agent, or Firm*—Majestic, Parsons, Siebert & Hsue

[57] ABSTRACT

A method and exercise device using air pressure to apply a high force to the body is provided. The force, although not gravity, resembles gravity in its influence on the musculoskeletal mechanics of locomotion because of the method of application (air pressure), and point of application (centroid of cross-section of waist-/hip area), and constant, controllable magnitude (regulated by the level of the pressure difference). The device also has possible wide applications on Earth in the areas of high performance athletic training and rehabilitation of trauma victims, low level paraplegics, orthopaedic hip implant recipients, and as a general exercise aid for elderly.

20 Claims, 9 Drawing Sheets

EXERCISE METHOD AND APPARATUS UTILIZING DIFFERENTIAL AIR PRESSURE

FIELD OF THE INVENTION

This invention relates generally to exercise equipment and more particularly to an apparatus and method which applies tissue loading or unloading with a differential air pressure exerted across the upper and lower body at the level of the hip or waist.

The government may have rights in this invention.

BACKGROUND OF THE INVENTION

The loss of bone strength, cardiovascular function, and muscle atrophy are the primary health-related concerns associated with long-term space flight. The probable cause of bone demineralization and muscle atrophy in space is the reduction in the levels of force required to perform activities, although other factors, unique to gravity- or acceleration-free environments, such as fluid shifts and the loss of fluid hydrostatic pressure gradients, may also exert a systemic influence. Presently, exercise protocols and equipment for space flight are unresolved, although recent calculations suggest that all exercise in space to date has lacked sufficient loads to maintain pre-flight musculoskeletal mass.

Gravity and one's daily physical activity level on Earth combine to impose a unique history of external and internal forces on the body. The time history of the muscle, bone, and cardiovascular tissue stresses determines to a large degree the material, geometric, and physiological properties of musculoskeletal and cardiovascular tissue. Altering the form and intensity of daily activity while in space can be expected to cause long term changes in the morphology and physiology of these tissues, as the evidence from space indicates.

A treadmill, in which the exerciser is connected to the cabin floor by elastic (bungy) cords attached at the waist and shoulders, is the principal exercise device used in space by both Soviet cosmonauts and U.S. astronauts. The treadmill provides cardiovascular exercise and musculoskeletal loading principally to the lower limbs. Walking and running on the treadmill have not been completely effective in maintaining musculoskeletal tissue, probably because the forces developed by the elastic cords are not equivalent in both magnitude and manner of application to the force of gravity on Earth. The application of force by the cords is uncomfortable and causes early fatigue.

SUMMARY OF THE INVENTION

It is the object of the present invention to provide an exercise method and device for walking and running in microgravity of space.

It is a further object of the invention to provide an exercise method and device for walking and running in hypergravity simulation on Earth.

It is still a further object of the prevent invention to provide an exercise method and device for walking and running in hypogravity simulation on Earth.

These and other objects of the invention are accomplished with the inventive method and exercise device which use air pressure in a new and innovative way to apply a high force to the body in space. The force, although not gravity, resembles gravity in its influence on the musculoskeletal and cardiovascular mechanics during locomotion because of the method of application (air pressure), and point of application (centroid of cross-section of waist/hip area), and constant, controllable magnitude (regulated by the level of the pressure difference). The device also has possible wide applications on Earth in the areas of high performance athletic training and rehabilitation of trauma victims, low level paraplegics, orthopaedic hip implant recipients, and as a general exercise aid for elderly.

DESCRIPTION OF THE PREFERRED EMBODIMENT

Theory

Figure 1A:
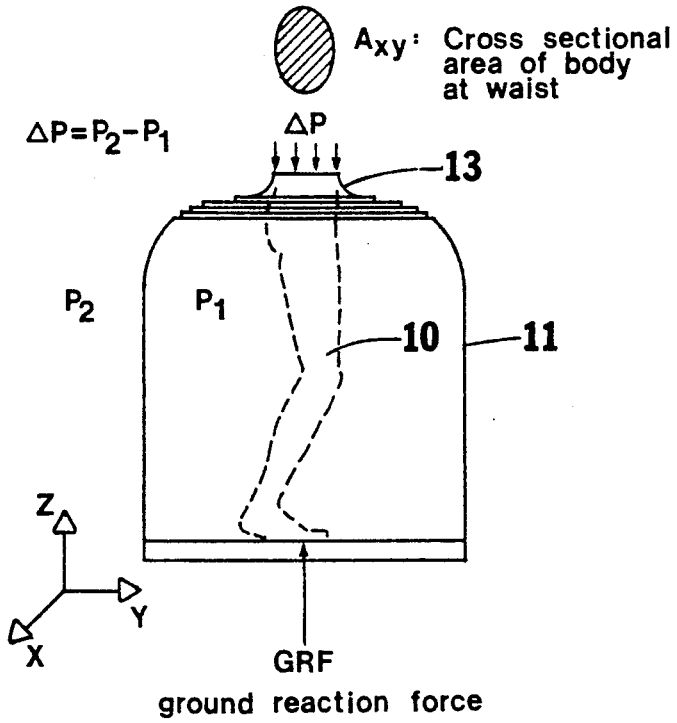
FIG. 1*a* is an illustration of a device for applying lower body negative pressure (LBNP) or lower body positive pressure (LBPP) by enshrouding the lower body.

The concept of imposing an external resultant force on the body with air pressure is illustrated in FIG. 1*a* in which the lower limbs 10 are enclosed in a chamber 11 isolated from the upper body (not shown) at the waist by a flexible, air seal 13. The seal allows "frictionless" movement in the axial (or "vertical") direction. Air pressure outside the chamber is designated as $P_2$ and the pressure inside the chamber as $P_1$. A resultant external force, located at the centroid of the cross-section in the plane of the seal is applied to the body when a difference in pressure, $\Delta P = P_2 - P_1$, exists. The force increases according to the following expression:

$$F_{air} = \Delta P * A_{xy} \qquad \text{Equation 1}$$

where $\Delta P$ is the pressure difference across the seal and $A_{xy}$ is the cross-sectional area of the body at the point of the seal.

Figure 1B:
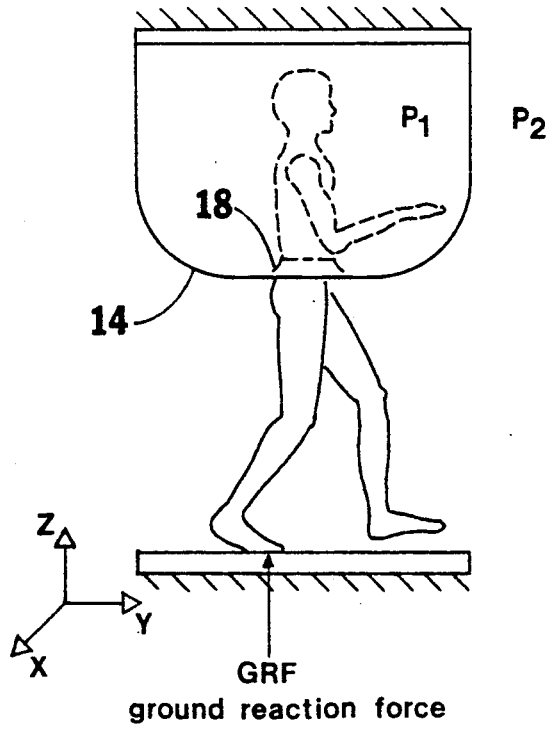
FIG. 1*b* is an illustration of a device for applying upper body negative (UBNP) or upper body positive pressure (UBPP) by enshrouding the upper body.

The force is directed footward when the pressure outside the chamber is greater than the inside pressure (lower body negative pressure or LBNP), and headward when the inside pressure is greater (lower body positive pressure or LBPP). Another novel and innovative preferred embodiment of this device and loading concept is illustrated in FIG. 1*b* in which the upper body is enshrouded by a chamber 14 of suitable material and separated by a waist/hip seal 18 from the outside air. To maintain the same sign convention for $F_{air}$ in Equation 1, $P_1$ is again the inside pressure and $P_2$ is the outside pressure, but $\Delta P = P_1 - P_2$. With this configuration a footward force, which adds to gravity on Earth, is created when the inside chamber pressure is greater than the outside pressure, $P_1 > P_2$, (upper body positive pressure or UBPP). Conversely, a headward force, which subtracts from gravity on Earth, develops when the inside chamber pressure is less than the outside pressure, $P_1 < P_2$, (upper body negative pressure or UBNP). Although the resultant force exerted on the body by the differential pressure is equivalent for the two concepts (FIGS. 1*a* and 1*b*), each configuration will produce unique effects on the cardiovascular system.

The magnitude of the vertical component of the ground reaction force is a good measure for comparing peak lower limb musculoskeletal forces developed during standing, walking, and running. On Earth during quiet standing in the chamber, the component of the ground reaction force in the normal direction, $G_z$, is $$G_z = F_{BW} + \Delta P^* A_{xy} \qquad \text{Equation 2}$$

where $F_{BW}$ is body weight. The ground reaction force will increase during treadmill walking and running in the chamber. Again on Earth during exercise the component of the ground reaction force in the direction normal to the surface of the treadmill is $$G_z = F_{BW} + \Delta P^* A_{xy} + Ma_z^{CM} \qquad \text{Equation 3}$$

where the inertia component, $Ma_z^{CM}$, is the force of accelerating and decelerating the center of mass of the body in the z-direction during exercise. In space only the pressure and inertia terms contribute to the total normal force. With the added inertia component the vertical ground reaction force, $G_z$, can reach as high as 2.5 to 3.5 body weights during running on Earth. It is anticipated that the same levels will be achieved in space with the inventive exercise device when the resultant force on the body from the pressure is the equivalent of one Earth body weight.

Based on estimates of hip and waist cross-sectional areas the level of LBNP (FIG. 1*a*) or UBPP (FIG. 1*b*) needed to produce a force equivalent to one Earth body weight was calculated. Areas were estimated for a wide range of sizes of men (2.5 to 97.5 percentile) and women (5 to 95 percentile) from hip and waist breadth, depth, and circumference data obtained from the literature. Literature values for hip and waist circumference were compared with circumferences calculated assuming an elliptical cross-section with body breath and depth measurements as major and minor diameters. The assumption of an ellipse underestimated the actual cross-sectional area at both the hip and waist. A better estimate of the area was obtained by interpolating the area between the ellipse and the rectangle enclosing the ellipse. The length of the circumference reported in the literature relative to the circumferences of the ellipse and rectangle was used as a basis for computing the area estimate.

Figure 2A:
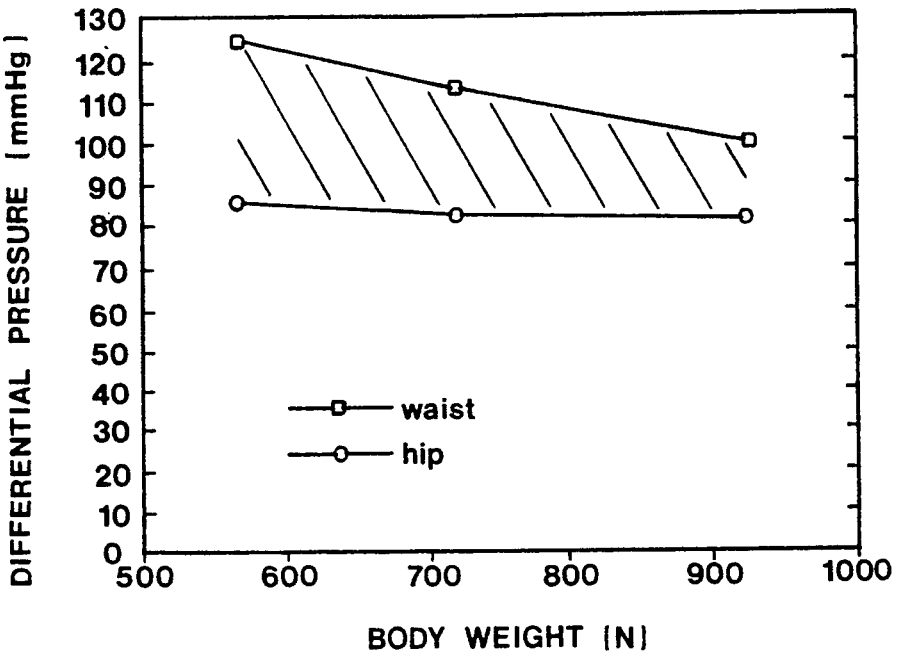
FIG. 2*a* is a graph of differential pressure versus body weight for men in predicting differential pressure needed to develop one body weight.
Figure 2B:
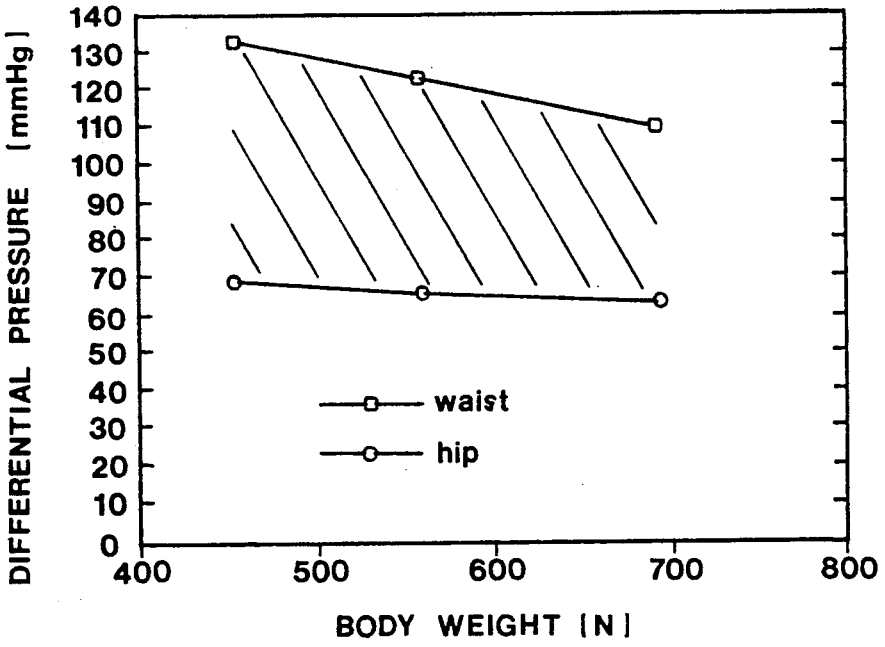
FIG. 2*b* is a graph of differential pressure versus body weight for women in predicting differential pressure needed to develop one body weight.

The level of LBNP (or UBPP) to produce one body weight of force for seal placements between the hip and waist is shown in FIGS. 2*a* (men) and 2*b* (women). At the 2.5, 50.0, and 97.5 percentiles, men's height (cm) and weight (N) are: (166.4, 568), (179.8, 720), and (194.6, 925), respectively. At 5.0, 50.0 and 95.0 percentiles, women's height (cm) and weight (N) are: (152.1, 456), (162.1, 560), and (172.2, 696), respectively. The range (shaded area) is larger for women owing to a greater difference between the hip and waist cross-sectional area compared to men. At the 50th percentile of size for men and women the average differential pressure for a seal located between the hip and waist is approximately 13.3 kPa (100 mm Hg). The level of pressure needed to produce one Earth body weight decreases slightly with increasing body size for both men and women.

The action of the gravitational force on the body on Earth can be compensated for by applying LBPP or UBNP. In this case, the above analysis applies, but the direction of force is reversed, i.e., approximately 100 mm Hg will completely unload the body on Earth.

Experimental

To test the theory that lower body negative pressure (LBNP) generates significant levels of load bearing, twelve male volunteers weighing 67.6–86.9 kg (663–852 N) were recruited for upright or supine LBNP studies after informed consent was obtained. In the upright configuration, each subject stood upon a calibrated weight scale placed on the bottom of the LBNP chamber. Subjects were sealed at the superior iliac crest with a rubber gasket. During supine LBNP, sheets of Teflon minimized frictional resistance to footward movement, and the feet were positioned comfortably flat against a foot plate. Footward force was measured to ±3 N by a calibrated load cell (model AJ-750, Interface Inc.) connected to the foot plate. Neither configuration included a saddle so that the force of the pressure differential was transmitted to the feet of our subjects. Each subject was exposed to 10 mm Hg (1.3 kPa) increments of LBNP up to 70 mm Hg (9.3 kPa) (standing) or to 50 to 100 mm Hg (6.7 to 13.3 kPa) (supine), depending upon individual tolerance. Pressure was then reduced in 10 mm Hg steps to ambient pressure. Static reaction force was measured at each LBNP level for approximately 1–2 minutes. Heart rate, blood pressure, and the subject's general condition were monitored to detect any presyncopal symptoms.

Results

Figure 3:
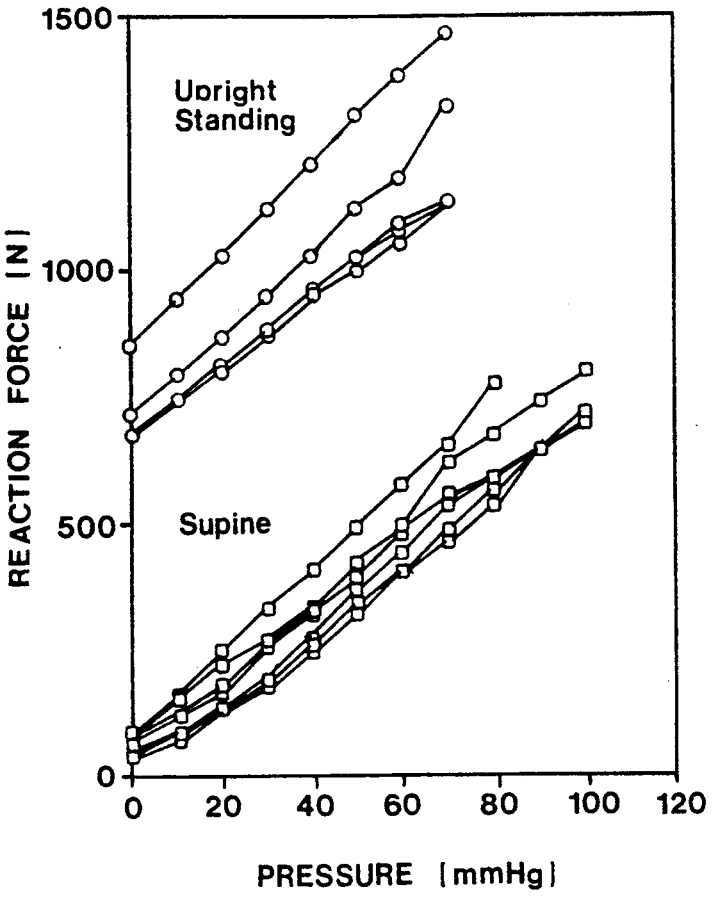
FIG. 3 is a graph of foot reaction force versus LBNP.

During upright-standing posture, ground reaction force increased linearly from each subject's body weight at approximately 1% initial weight per one mm Hg LBNP (FIG. 3, upper results). Likewise, in supine subjects, footward force increased linearly with LBNP (FIG. 3, lower results). Theoretically, recumbency was more analogous to actual microgravity because there was an absence of body weight acting on the feet under initial conditions of ambient pressure within the LBNP chamber (the footward force vector was neither directed nor supplemented by the Earth's gravity vector). Regression of the increase in footward force as a percentage of initial body weight (%BW) against LBNP $\%BW = 0.99\ LBNP + 3.20$, (where $r^2 = 0.965$, $p < 0.0001$).

Figure 4:
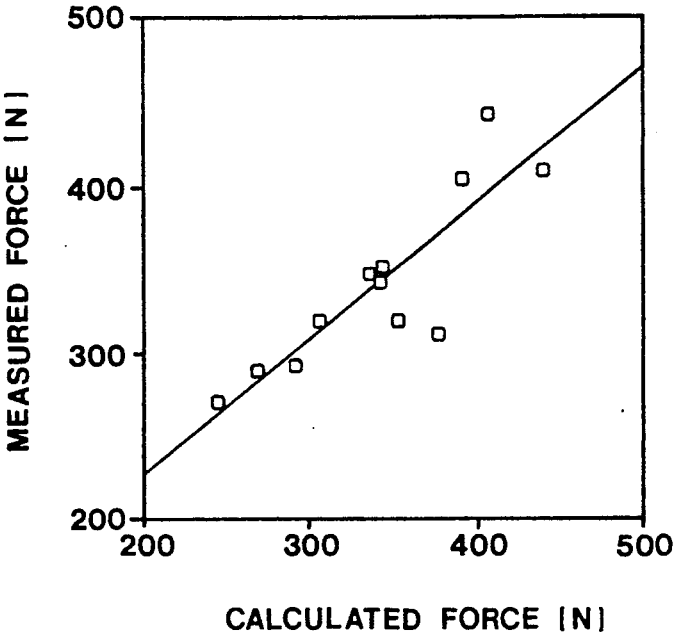
FIG. 4 is a graph of measured foot reaction force versus calculated force based on Equation 1.

Measurement of body cross-sectional area at the superior iliac crest confirmed that this area, lying in the plane of the seal, accurately predicted the footward load induced by LBNP. Assuming an elliptical transverse cross-section and measuring coronal and sagittal waist diameters ($d_c$ and $d_s$) at the level of the LBNP seal, the force acting through the $\pi\ r_c\ r_s$ at an arbitrary LBNP level of 50 mm Hg was calculated (FIG. 4). Regression of the measured force ($F_{meas}$) at 50 mm Hg against the calculated force ($F_{calc}$) yielded the relationship for the 12 subjects:

$$F_{meas}=0.81\ F_{calc}+65,\ (\text{where } r^2=0.756,\ p=0.0002).$$

Discussion

These findings concerning the magnitude and mechanism of force production by differential air pressure have important implications for simulating gravity in space without a centrifuge and for increasing (and decreasing) weight bearing on Earth.

A. Walking and Running in the Microgravity of Space

The net external axial force exerted on the body by the difference in upper and lower body air pressure resembles the action of gravity in several important ways. Although not a body force like gravity, the air pressure is uniformly distributed over the surface of the skin, and the resultant is therefore not detected as a localized force pulling down (or pushing) on the body. Second, the center of pressure, the location of the resultant force, is at or very near the center of mass of the body (and center of gravity on Earth) during walking and running. Third, the force throughout the gait cycle should be nearly constant even without pressure regulation, since the volume of displaced air in the chamber during exercise is small compared to the total chamber volume. If the chamber is air-tight, the device produces a conservative force, like a constant force spring.

It is believed that with a constant force equivalent to one Earth body weight and the center of pressure close to the center of mass, gait (and the musculoskeletal forces in the lower limbs) in space will resemble gait on Earth, even in the absence of segment weights and gravitational moments of force. The inventive apparatus permits activities in space that provide tissue stress states and tissue stress histories either comparable or equivalent to skeletal loading on Earth in order to avoid musculoskeletal and cardiovascular tissue adaptation and loss of motor coordination.

The level of force is easily regulated to provide a range of exercise conditions. The capacity to generate high forces is significant with a maximum of about 7.5 body weights for a fully evacuated chamber and an ambient pressure of 1 atm, but the maximum design load in space is not expected to exceed 1.5 to 2.0 body weights ($\Delta P=20.0$–$26.6$ kPa, or 150–200 mm Hg). High forces with relatively few loading cycles may be the most effective way to maintain bone mass, in which case the imposed force may be greater than one Earth body weight. Aerobic and endurance training could be performed by running on the treadmill at levels of applied force at or below the equivalent of one Earth body weight. Significant musculoskeletal and cardiovascular forces are also generated in the upper body during walking and running, even in the absence of gravity, by the inertia forces and inertia torques imposed on the upper body segments.

Extrapolation of upright-standing results indicates that ground reaction force (GRF) increases by approximately one equivalent body weight for each 100 mm Hg LBNP (or UBPP). The supine data suggest that during microgravity, uniaxial loading of lower-body tissues can be induced by a similar level of LBNP. Furthermore, the lower-body musculoskeletal loss experienced by crew exposed to long-term spaceflight may be prevented by safe and predictable levels of high-intensity, short-duration exercise within such a chamber.

High levels of saddle-supported LBNP can produce cardiovascular effects such as venous pooling, lower-body edema, central blood volume depletion, and syncope. During exercise against high levels of LBNP, the skeletal muscle pumping mechanism may counteract accumulation of blood in hyperemic lower extremities, as occurs during upright exercise in Earth gravity and during exercise on a centrifuge under hypergravity conditions. Nevertheless, pooling of blood and tissue fluid in the lower body due to high levels of LBNP could be avoided by wearing an elastic garment or "antigravity suit" within the chamber. Such trousers could partially counteract the LBNP-induced increase of transmural pressure across vessels of the lower body.

Variations of blood pressures due to inertial loads with normal gait have been documented in humans and other animals, and such local variations in blood pressure may well be important for maintenance of normal vascular function in dependent tissues. For example, arteries in feet have thicker smooth muscle walls than arteries of similar caliber in the upper body. This local adaptation allows better regulation of blood flow to tissues of the feet during upright posture. During long-duration spaceflight, these gravitational adaptations of the vascular system to local blood pressure could be attenuated or lost. Although LBNP does not provide the normal, 1-g gradient of blood pressures from waist to feet that exist on Earth, it does allow high levels of inertial loading of lower body blood vessels producing transient hydrostatic pressure gradients during exercise, so that local variations in vascular morphology and tone maybe maintained.

Exercise within an LBNP chamber (or UBPP chamber) during space flight may reproduce the functional interdependence of the cardiovascular and musculoskeletal systems during normal daily activities on Earth. A treadmill, stairclimber, or other exercise equipment could be placed within the chamber to provide inertial forces and eccentric-type training exercises that may help to maintain bone and muscle mass. It is possible that short periods of near-maximal effort may optimize the benefit/time ratio for maintaining health and performance of crew members in space, and for exercise training on Earth. Finally, exercise within an LBNP chamber (or UBPP chamber) in space may provide an inexpensive and compact alternative to centrifugation during long-duration, interplanetary travel.

B. Walking and Running in Hypergravity Simulation on Earth

The device has potential uses on Earth as well. One application may be as a physical training aid. Distributing weights over the body to increase body weight has been used to simulate hypergravity training on Earth. Disadvantages of this method are (1) mass is added in addition to force, thereby changing the inertia properties and dynamic characteristics of the body, (2) the center of mass is shifted unless great care is taken in placing the weights, and (3) the weights are uncomfortable. For other equally compelling reasons, bungy cords attached at the waist also do not work well. Centrifugation overcomes these problems, but a short radius and high angular velocities introduce a Coriolis force and vestibular disturbances that may affect performance.

Figure 5A:
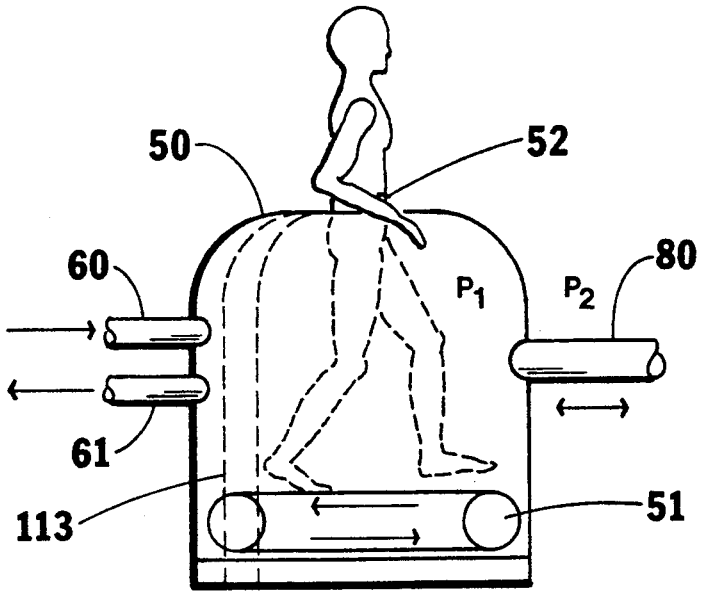
FIG. 5*a* is an illustration of a lower body differential pressure device.

It is believed that the differential air pressure chamber can also be used to provide a high performance physical training to athletes and to study locomotion, cardiovascular physiology, and musculoskeletal adaptation to walking and running in hypergravity. Walking or running in the chamber on Earth with a force augmented by negative pressure (Equation 2) is a first order approximation to training in hypergravity. The device in the upright position shown in FIG. 5*a* is used to either replace gravity in space or augment the gravitational force (body weight) on Earth with a force created by negative chamber pressure (LBNP). In this device, chamber 50 is suitably constructed of an airtight material such as structural foam, plastic or metal. The chamber can be reinforced with frame 113. Housed inside the chamber is an exercise device such as a treadmill, stairclimber, or other such device. A person using the device lowers himself partway into the chamber and onto the exercise device which is a treadmill 51. The lower body is enclosed at the waist by a flexible, vacuum seal 52.

The inside of the chamber is connected to conduits 60 and 61 which in turn are connected to a temperature and humidity recirculation unit. Similarly, conduit 80 is connected to an air pressure regulation unit. Any suitable device such as a pump can be used to increase or decrease the pressure inside the chamber during exercise.

It is estimated that a negative pressure of 6.7 kPa (50 mm Hg, −1 psi) will impose an additional force of ½ body weight for a total external force of 1.5 body weight during quiet standing. This is the equivalent of a 1.5 g gravitational field in terms of the ground reaction support force, and the action of the two forces on the body center of mass.

Figure 5B:
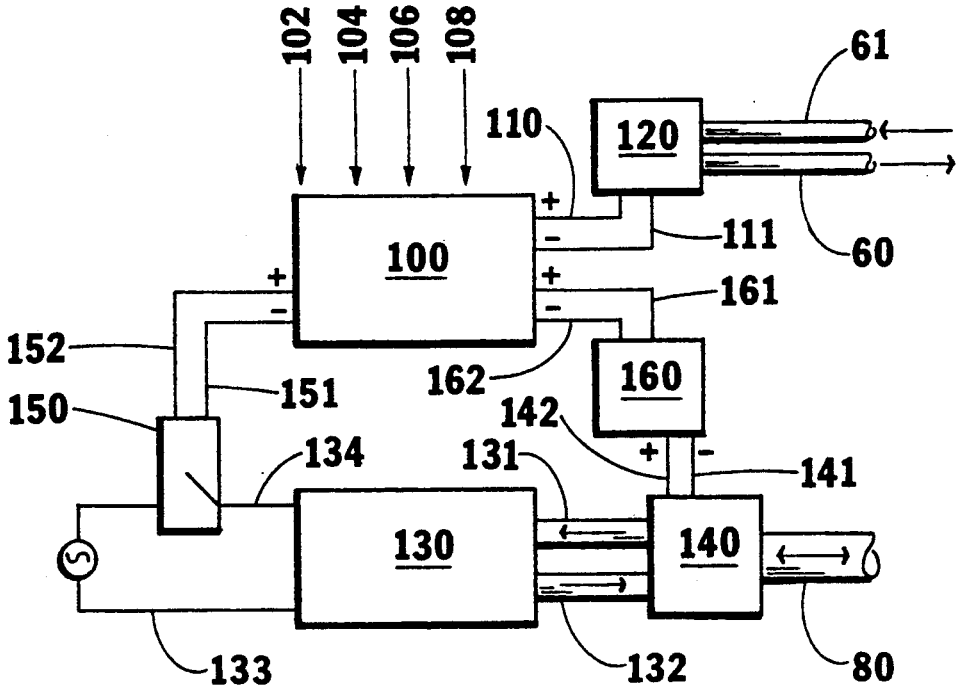
FIG. 5*b* is an illustration of a temperature-humidity recirculation unit and an air pressure regulation unit.

FIG. 5*b* is a schematic of a temperature-humidity humidity recirculation unit and an air pressure regulation unit for a lower body chamber. Pressure, temperature, and humidity sensors, that are attached to the inside chamber wall of an inventive device such as the LBNP device shown in FIG. 5*a*, can be connected by leads 102, 106, and 108, respectively, to temperature, humidity, and pressure controller 100. The controller regulates through control lines 110 and 111 heat pump 120 which recirculates air into the chamber via conduit 60. Pressure inside the chamber is maintained by vacuum motor source 130 which is connected to servo valve 140 via conduits 131 and 130. The servo valve is connected to servo valve driver 160 by leads 141 and 142, and the servo valve driver is connected to the controller by servo control lines 161 and 162. The vacuum motor source is connected to relay 150 by leads 133 and 134. The relay in turn is connected to the controller by relay control lines 151 and 152.

An individual exercising in the LBNP device of FIG. 5*a* can also wear a wrist controller to regulate the temperature, humidity, and pressure via telemetry.

Alternative methods of controlling pressure include (1) the use of any sufficient vacuum/blower source and a pressure control valve, or (2) the fresh air flow-through system described below for the upper body chamber.

Figure 5C:
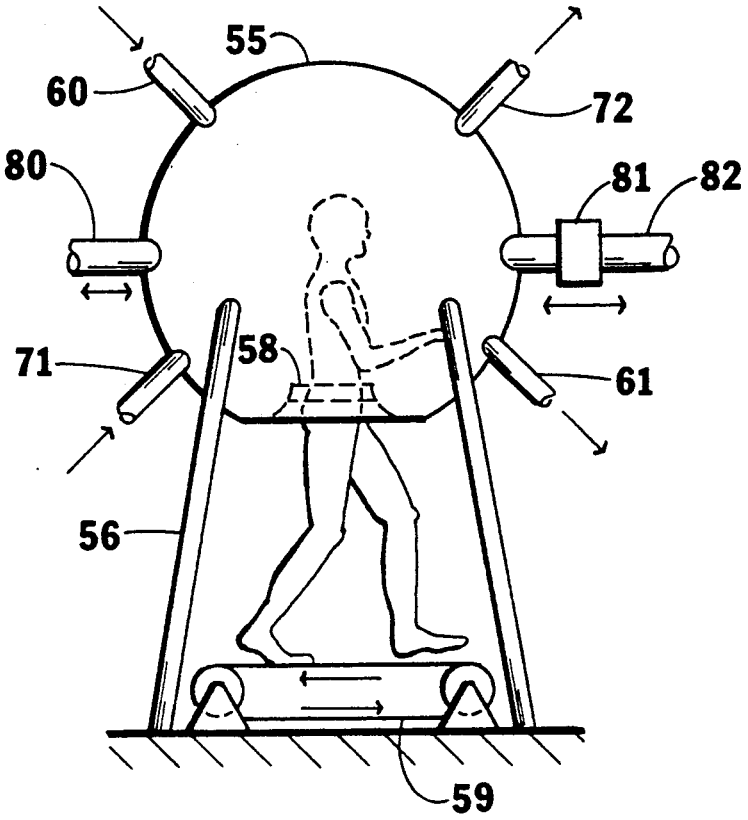
FIG. 5*c* is an illustration of an upper body differential pressure device.

FIG. 5*c* is an upper body positive pressure device which is equivalent to a LBNP device in terms of the direction and point of application of the external force created by the pressure difference. The device comprises a spherical dome-like chamber 55 preferably made of clear plastic. The chamber is supported by a tube frame 56. For positive upper body pressure, the spherical dome 55 may be constructed of coated fabric or clear film, and the frame 56 of flexible cables. A person using the device first enters partway into the chamber through the aperture which is equipped with seals 58. In this embodiment, the individual uses treadmill 59.

The inside of the chamber is connected to conduits 60 and 61 which in turn are connected to a temperature and humidity recirculation unit. Similarly, conduit 80 is connected to an air pressure regulation unit. Any suitable device such as a pump can be used to increase or decrease the pressure inside the chamber during exercise.

Figure 5D:
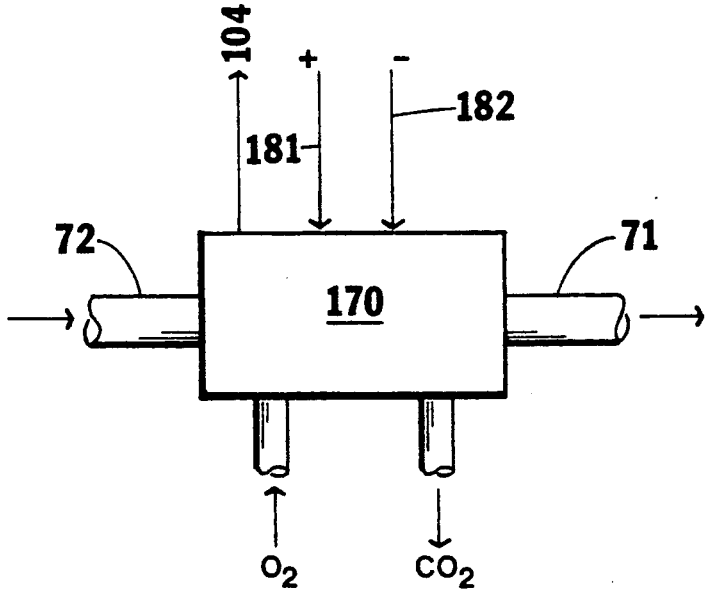
FIG. 5*d* is an illustration of a ventilation and gas monitoring and regulating system for upper body chambers.

An electromechanical valve 81 and inlet/outlet port 82 operate together with the pressure regulating servo valve 140 (FIG. 5*b*) to deliver a regulated flow of fresh air to the upper body of the exerciser. Alternatively, in FIG. 5*d* a gas monitor 170 and regulator circulate chamber air through chamber outlet 72 and inlet 71 and maintain fixed or programmable gas concentrations through sensor input 104 and control lines 181 and 182 from the controller 100 (FIG. 5*b*).

C. Walking and Running in Hypogravity Simulation on Earth

Water immersion and parallel rails are commonly used in physical therapy and physical training as methods of reducing the level of force on the body. Weights are also commonly used in underwater simulation of hypogravity. Problems associated with using water immersion to study hypogravity are (1) the center of buoyancy is not at the center of mass, (2) the resistance of viscous drag will affect motion, (3) additional weights add mass which changes the inertia properties of the subject, and (4) water immersion therapy is an inappropriate treatment for patients with open wounds. Moreover, some patients cannot use arms on rails. Collection of electromyography (EMG) data, intramuscular pressures (IMP), and other physiological data is also difficult or impossible.

It is believed that the differential air pressure chamber can also be used to study locomotion, cardiovascular physiology, and musculoskeletal adaptation to walking and running in hypogravity. A positive lower body chamber pressure (LBPP), or equivalently UBNP, will reverse the direction of the pressure force and oppose gravity at the center of mass of the subject. The result will be a net reduction in the level of force exerted on the body. For example, a LBPP (or UBNP) of 11 kPa (83 mm Hg, 1.6 psi) will simulate the pull of gravity on the Moon. Mars'gravitational field is simulated with a positive pressure of 8.24 kPa (62 mm Hg, 1.2 psi). Again, the same limitations apply when equating these forces to true gravitational forces.

One significant application of a hyprogravity simulator will be in the area of rehabilitation on Earth. The level of musculoskeletal forces experienced by a person is easily controlled by the magnitude of the chamber pressure. With a positive pressure as low as 6.7 kPa (about what it takes to inflate a stiff balloon), it is possible to unweight an individual to about half his or her body weight. In this case walking and running can be performed at reduced levels of musculoskeletal loading in the lower limbs and joints of the foot, knee, and hip as the gravitational force of body weight is reduced by the upward force created by positive chamber pressure.

The device may be used to assist in the reambulation of trauma and stroke patients, or as a "walking exerciser" for persons with arthritis. The equipment may also be used in the rehabiliation of hip implant patients wheel full weight-bearing during walking is either not possible or desirable.

Figure 6A:
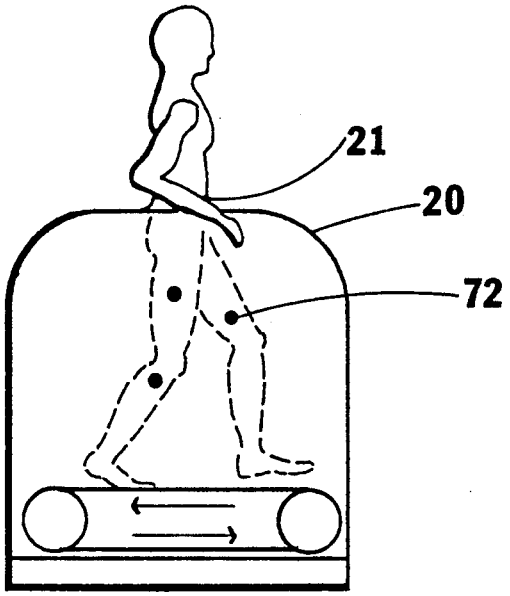
FIG. 6*a* is an illustration of a lower body positive pressure chamber designed for hypogravity walking-/running.

The inventive device for hyprogravity exercise using a lower body chamber and positive pressure is illustrated in FIG. 6*a*. It consists of an inflatable chamber 20 constructed of coated fabric or clear film to permit motion analysis of gait. As with the device described in FIG. 5*a*, this device is equipped with a flexible waist seal 21 which allows sufficient translational and rotational motion to minimize interference with normal running motion on the treadmill. Similarly, the chamber can be connected to an air pressure/humidity controller. The transparent reinforced vinyl surface creates a light, stowable system. Reflecting circular patches 72 on the legs of the individual, can be used for 3-D motion analysis. A standard commercial vacuum/blower is sufficient for pressure production. Pressure, temperature, and humidity control are not shown, but can be included.

Hypogravity exercise using an upper body chamber and negative pressure is illustrated in FIG. 5*c* configured with a stiff shell to support compressive forces. Pressure, ventilation, $O_2/CO_2$, temperature, and humidity control are not shown, but can be added.

D. Combined Hypergravity and Hypogravity Protocols on Earth

Muscle and bone have different responses to the magnitude and frequency of the daily forces imposed on the respective tissues. It may prove advantageous for both training and rehabilitation to load musculoskeletal tissue to high levels (hypergravity simulation) to stimulate an increase in muscle and bone mass, but minimize joint trauma, and then reduce the level of force to hypogravity levels for longer durations in order to provide metabolic exercise and low force joint motion. Chamber positive and negative pressure-time profiles can be tailored to specific needs.

Figure 6B:
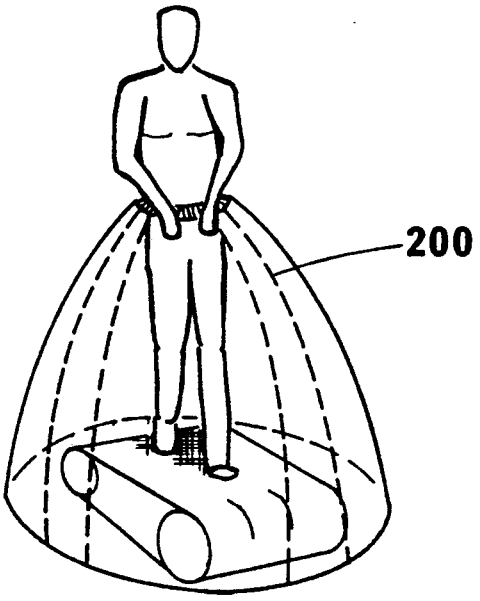
FIG. 6*b* is an illustration of an embodiment of a combined hypo/hypergravity exercise chamber.

Combined protocols can be realized by both upper and lower body chambers. FIG. 6*b* illustrates one lower body chamber design utilizing a tubular steel frame 200 covered with a transparent fiber-reinforced air-tight film. Compressive forces, imposed on the structure by a negative chamber pressure during hypergravity simulation on Earth are transferred to the steel frame by the fabric. Tensile membrane stresses carried by the film withstand the internal positive pressure during hypogravity simulation. Upper body combined protocols are equally feasible utilizing a geodesic tubular structure with transparent skin.

E. Applying Differential Pressure Loading To Appendages

Figure 7:
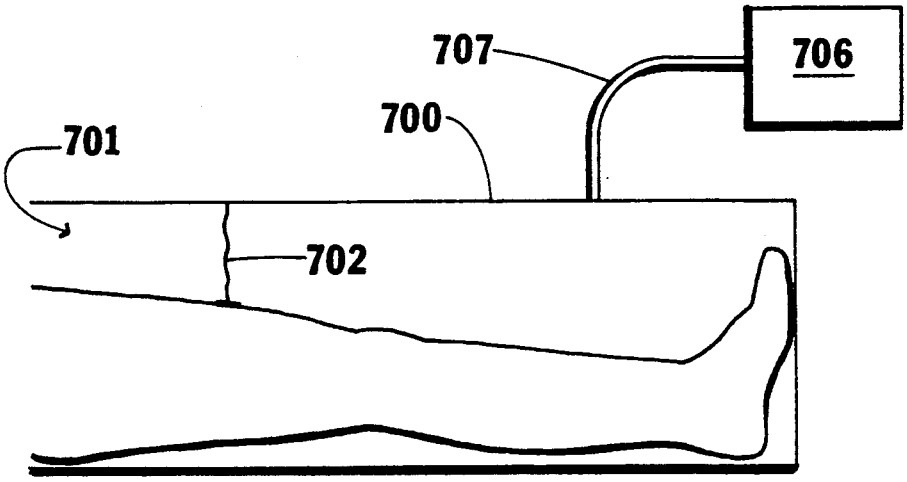
FIG. 7 is an illustration of a device for differential pressure applied to a single limb.

The invention is applicable to loading a single arm or leg in order to promote healing of fractures or wounds in patients who must maintain bed rest. In FIG. 7, a rigid cylindrical chamber 700 made of air-tight material is shown. One end of the cylinder has an aperture 701 through which the patient's leg is carefully placed. In this embodiment, seal 702 is positioned above the knees. Thereafter, a partial vacuum is created inside the chamber by vacuum system 706 which is connected via conduit 707 to the inside of the chamber. This device can be used horizontally, vertically, or at any angle in between.

F. Waist Seal Designs

Figure 8A:
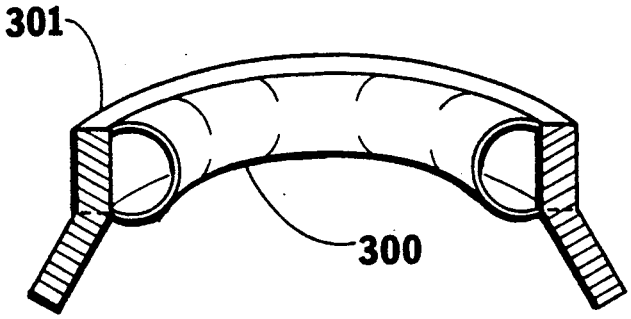
FIG. 8 are illustrations of various vacuum (pressure) seal designs.
Figure 8B:
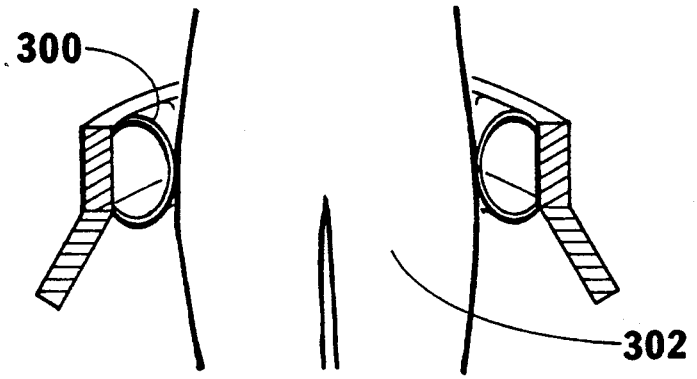
Figure 8C:
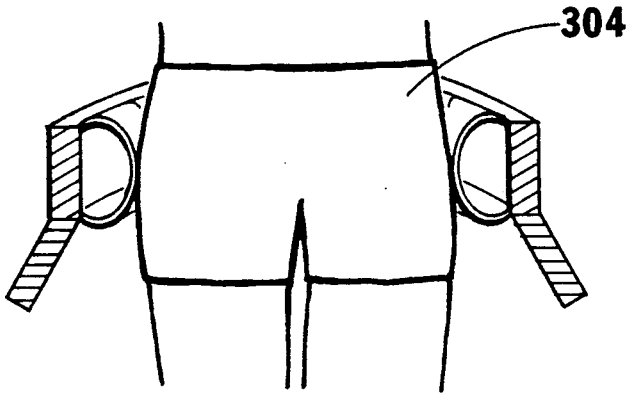
Figure 8D:
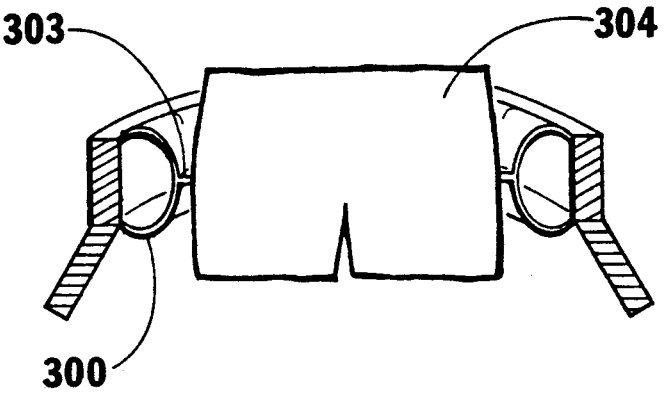
Figure 8E:
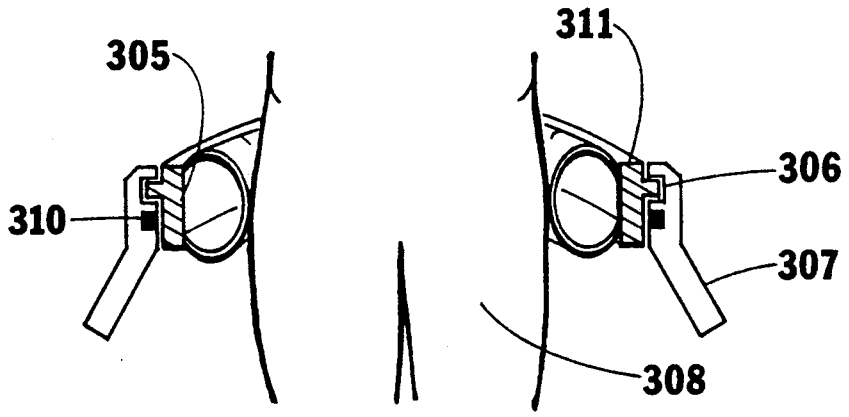
Figure 8F:
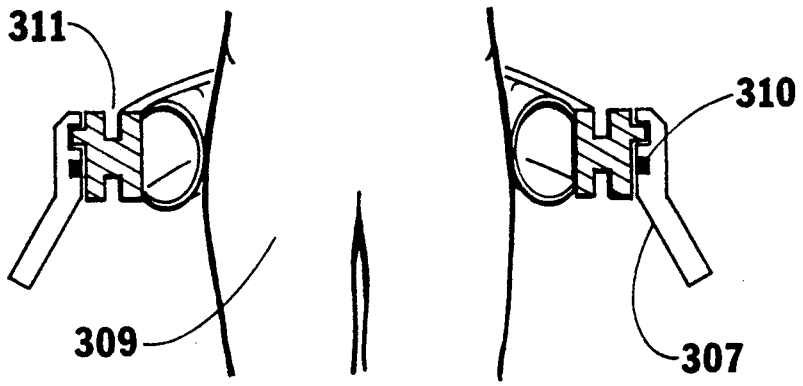
Figure 8G:
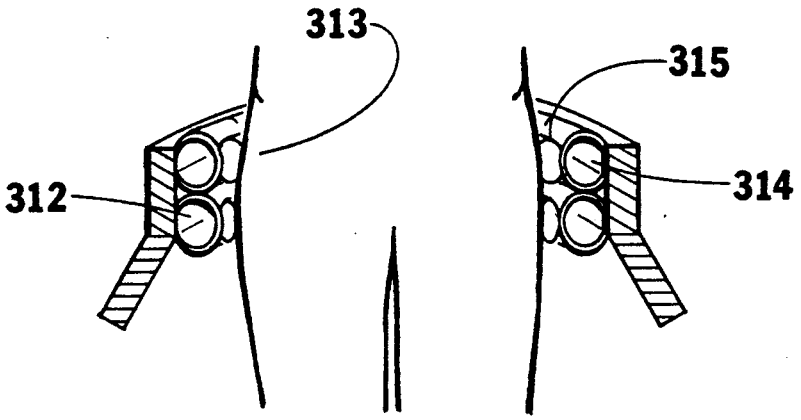

The basic seal design comprises an inflatable ring 300 attached to the shrouding 301 at the waist (FIG. 8*a*). Although not shown, directly the inflatable ring is curved in an elliptical shape to conform more closely to the body. With exerciser 302 in the chamber the inflatable ring 300 conforms to the hip surface (FIG. 8*b*) forming a low leakage seal. A better seal can be obtained by sewing with air-tight fabric 303 the inflatable ring 300 to a stretch band or pair of stretch pants 304 (FIGS. 8*c* and 8*d*). The waist seal assembly 305 can be bayonet 306 or similarly mounted to the shrouding 307 to accommodate a range of body sizes 308, 309 (FIGS. 8*e* and 8*f*). In this embodiment, the waist seal assembly locks into the shrouding 307 and is sealed by an o-ring 310. Flanges 311 are constructed of different widths to fit different waist dimensions. In FIG. 8*g* multiple inflation rings 312 conform to the body surface 313. Each inflation ring is a composite of a large ring 314 and a smaller ring 315, internally connected to the same pressure source (not shown). At high pressures the larger ring 314 will become rigid and the smaller ring 315 will remain deformable as shown.

It is to be understood that while the invention has been described above in conjunction with preferred specific embodiments, the description and examples are intended to illustrate and not limit the scope of the invention, which is defined by the scope of the appended claims.

It is claimed:

1. An exercise apparatus that provides differential air pressure musculoskeletal and cardiovascular loading to an individual who is in an upright position comprising:

a chamber constructed of substantially air-tight material and suitable constructed with an aperture for enshrouding the individual's lower body;

means for providing a seal between the aperture and the individual so that the chamber is substantially air-tight, wherein the seal means attaches at or near the individual's waist;

means for reducing the pressure in the chamber; and an exercise device housed in the chamber.

2. An exercise apparatus that provides differential air pressure musculoskeletal and cardiovascular loading to an individual who is in an upright position comprising:

a chamber constructed of substantially air-tight material and suitably constructed with an aperture for enshrouding the individual's lower body;

means for providing a seal between the aperture and the individual so that the chamber is substantially air-tight, wherein the seal means attaches at or near the individual's waist;

means for increasing the pressure in the chamber; and an exercise device housed in the chamber.

3. An exercise apparatus that provides differential air pressure musculoskeletal and cardiovascular loading to an individual who is in an upright position comprising:

a chamber constructed of substantially air-tight material and suitably constructed with an aperture for enshrouding the individual's upper body;

means for providing a seal between the aperture and the individual so that the chamber is substantially air-tight, wherein the seal means attaches at or near the individual's waist;

means for increasing the pressure in the chamber; and an exercise device that is positioned outside the chamber.

4. An exercise apparatus that provides differential air pressure musculoskeletal and cardiovascular loading to an individual who is in an upright position comprising:

a chamber constructed of substantially air-tight material and suitably constructed with an aperture for enshrouding the individual's upper body;

means for providing a seal between the aperture and the individual so that the chamber is substantially air-tight, wherein the seal means attaches at or near the individual's waist;

means for decreasing the pressure in the chamber; and an exercise device that is positioned outside the chamber.

5. The apparatus as defined in either claim 1, 2, 3, or 4 wherein the exercise device comprises a saddleless device suitably constructed for eccentric-type training.

6. The apparatus as defined in claim 5 wherein the exercise device comprises of a treadmill or stepclimber.

7. A method of exercise where differential air pressure musculoskeletal loading and cardiovascular is applied to an individual who is in the upright position where the pressure's center is substantially at the individual's center of gravity, comprising the steps of:

providing a chamber constructed of substantially air-tight material and suitably constructed with an aperture, for enshrouding the individual's lower body, wherein the chamber includes an exercise floor that is of sufficient construction to support the individual during exercise;

providing a seal between the aperture and the individual so that the chamber is substantially air-tight, wherein the seal is attached to or near the individual's waist; and reducing the pressure inside the chamber.

8. The method of exercise as defined in claim 7 further comprising the step of positioning a saddleless exercise apparatus onto the exercise floor.

9. The method of exercise as defined in claim 8 wherein the step of positioning a saddleless exercise apparatus comprises of placing a treadmill or stepclimber on the exercise floor.

10. A method of exercise where differential air pressure musculoskeletal and cardiovascular loading is applied to an individual who is in the upright position where the pressure's center is substantially at the individual's center of gravity, comprising the steps of:

providing a chamber constructed of substantially air-tight material and suitably constructed with an aperture, for enshrouding the individual's lower body, wherein the chamber includes an exercise floor that is of sufficient construction to support the individual during exercise;

providing a seal between the aperture and the individual so that the chamber is substantially air-tight, wherein the seal is attached to or near the individual's waist; and increasing the pressure inside the chamber.

11. The method of exercise as defined in claim 10 further comprising the step of positioning a saddleless exercise apparatus onto the exercise floor.

12. The method of exercise as defined in claim 11 wherein the step of positioning a saddleless exercise apparatus comprises of placing a treadmill or stepclimber on the exercise floor.

13. The method of exercise where differential air pressure musculoskeletal and cardiovascular loading is applied to an individual who is in the upright position where the pressure's center is substantially at the individual's center of gravity, comprising the steps of:

providing a chamber constructed of substantially air-tight material and suitably constructed with an aperture, for enshrouding the individual's upper body;

positioning said chamber above an exercise floor that is of sufficient construction to support the individual during exercise;

providing a seal between the aperture and the individual so that the chamber is substantially air-tight, wherein the seal is attached to or near the individual's waist; and increasing the pressure inside the chamber.

14. The method of exercise as defined in claim 13 further comprising the step of positioning a saddleless exercise apparatus onto the exercise floor.

15. The method of exercise as defined in claim 14 wherein the step of positioning a saddleless exercise apparatus comprises of placing a treadmill or stepclimber on the exercise floor.

16. A method of exercise where differential air pressure musculoskeletal and cardiovascular loading is applied to an individual who is in the upright position where the pressure's center is substantially at the individual's center of gravity, comprising the steps of:

providing a chamber constructed of substantially air-tight material and suitably constructed with an aperture, for enshrouding the individual's upper body;

positioning said chamber above an exercise floor that is of sufficient construction to support the individual during exercise;

providing a seal between the aperture and the individual so that the chamber is substantially air-tight, wherein the seal is attached to or near the individual's waist; and decreasing the pressure inside the chamber.

17. The method of exercise as defined in claim 16 further comprising the step of positioning a saddleless exercise apparatus onto the exercise floor.

18. The method of exercise as defined in claim 17 wherein the step of positioning a saddleless exercise apparatus comprises of placing a treadmill or stepclimber on the exercise floor.

19. A therapeutic method of exercise where differential air pressure musculoskeletal and cardiovascular loading is applied to an individual who is in the upright position where the pressure's center is substantially at the individual's center of gravity, comprising the steps of:

providing a chamber including an exercise device therein, said chamber being constructed of substantially air-tight material and suitably constructed with an aperture, for enshrouding the individual's lower body;

providing a seal between the aperture and the individual so that the chamber is substantially airtight, wherein the seal is attached to or near the individual's waist;

decreasing the pressure inside the chamber; and then increasing the pressure inside the chamber.

20. A therapeutic method of exercise where differential air pressure musculoskeletal and cardiovascular loading is applied to an individual who is in the upright position where the pressure's center is substantially at the individual's center of gravity, comprising the steps of:

providing a chamber constructed of substantially air-tight material and suitably constructed with an aperture, for enshrouding the individual's upper body;

positioning an exercise device below said chamber;

providing a seal between the aperture and the individual so that the chamber is substantially airtight, wherein the seal is attached to or near the individual's waist;

decreasing the pressure inside the chamber; and then increasing the pressure inside the chamber.

* * * * *